US008282441B2

(12) United States Patent
Mays

(10) Patent No.: US 8,282,441 B2
(45) Date of Patent: Oct. 9, 2012

(54) COMFORT SUPPORT BRASSIER AND METHOD

(76) Inventor: Rick Mays, Madison Heights, VA (US)

( * ) Notice: Subject to any disclaimer, the term of this patent is extended or adjusted under 35 U.S.C. 154(b) by 368 days.

(21) Appl. No.: 12/754,711

(22) Filed: Apr. 6, 2010

(65) Prior Publication Data

US 2011/0244757 A1 Oct. 6, 2011

(51) Int. Cl.
*A41C 3/00* (2006.01)
*A41C 3/14* (2006.01)

(52) U.S. Cl. ..... 450/60; 450/41

(58) Field of Classification Search ..... 450/31, 450/33, 41, 45–49, 51, 52, 59–63, 67, 78
See application file for complete search history.

(56) References Cited

U.S. PATENT DOCUMENTS

| | | | |
|---|---|---|---|
| 1,590,693 | A | 6/1925 | McKeefrey |
| 1,595,389 | A | 8/1926 | Espinosa |
| 2,015,151 | A | 9/1935 | Moity |
| 2,092,390 | A | 9/1937 | Federico |
| 2,149,819 | A | 3/1939 | Rubinstein |
| 2,175,676 | A | 10/1939 | Walters |
| 2,400,499 | A | 5/1946 | Gerace |
| 2,523,715 | A | 9/1950 | Panes |
| 2,624,049 | A | 1/1953 | Granne |
| 2,628,357 | A | 2/1953 | Sider |
| 2,995,133 | A | 8/1961 | Erteszek |
| 3,145,714 | A | 8/1964 | Brown |
| 3,200,821 | A | 8/1965 | Anderson |
| 3,213,462 | A | 10/1965 | Ramsell |
| 3,306,299 | A | 2/1967 | Paramore |
| 3,847,158 | A | 11/1974 | Guidoni |
| 3,873,403 | A | 3/1975 | Edelman |
| 3,939,845 | A | 2/1976 | Guidoni |
| 5,797,786 | A | 8/1998 | Smith et al. |
| 5,971,834 | A | 10/1999 | Murray |
| 6,213,842 | B1 | 4/2001 | Degirmenci |
| 7,267,599 | B2 | 9/2007 | Allen et al. |
| 7,452,260 | B2 | 11/2008 | Redenius |
| 7,470,168 | B1 | 12/2008 | Farrell |
| 7,497,760 | B2 | 3/2009 | Redenius |
| 2005/0277364 | A1 | 12/2005 | Redenius |
| 2008/0090491 | A1 | 4/2008 | Liu |
| 2009/0061731 | A1 | 3/2009 | Redenius |

OTHER PUBLICATIONS

All Experts: Brassiere: Encyclopedia; Mar. 9, 2010 http://en.allexperts.com/e/b/br/brassiere.htm.
Enotes; How Products are Made | Brassiere; Mar. 8, 2010; http://www.enotes.com/how-products-encyclopedia/brassiere.htm.

*Primary Examiner* — Gloria Hale
(74) *Attorney, Agent, or Firm* — Pravel Intellectual Property Law, P.C.; James W. Pravel

(57) ABSTRACT

A brassiere includes a take-up member having an inner and an outer take-up segment. The take-up segments follow the outer curvature of the upper portion of the brassiere cup. The lower ends of the take-up segments are attached at or near the ends of the lower edge of the cup, which extends side to side, below the breast. The lower edge of the cup can comprise an uplifting wire, a support strip, a bent support strip or a simple seam.

17 Claims, 6 Drawing Sheets

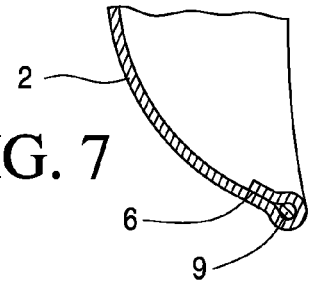
FIG. 7
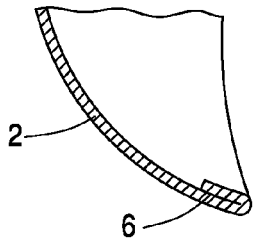
FIG. 10
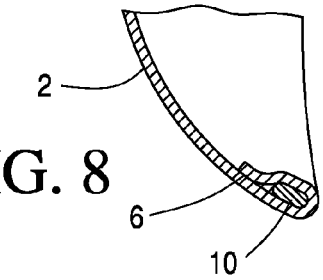
FIG. 8
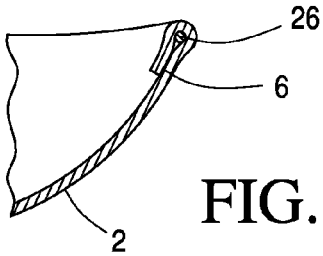
FIG. 11
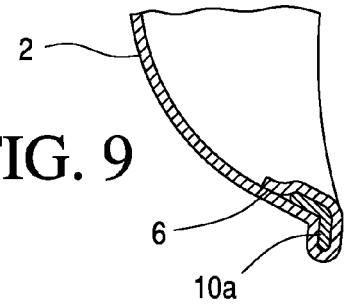
FIG. 9
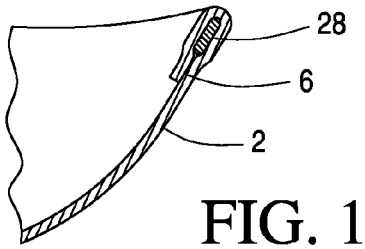
FIG. 12
FIG. 13
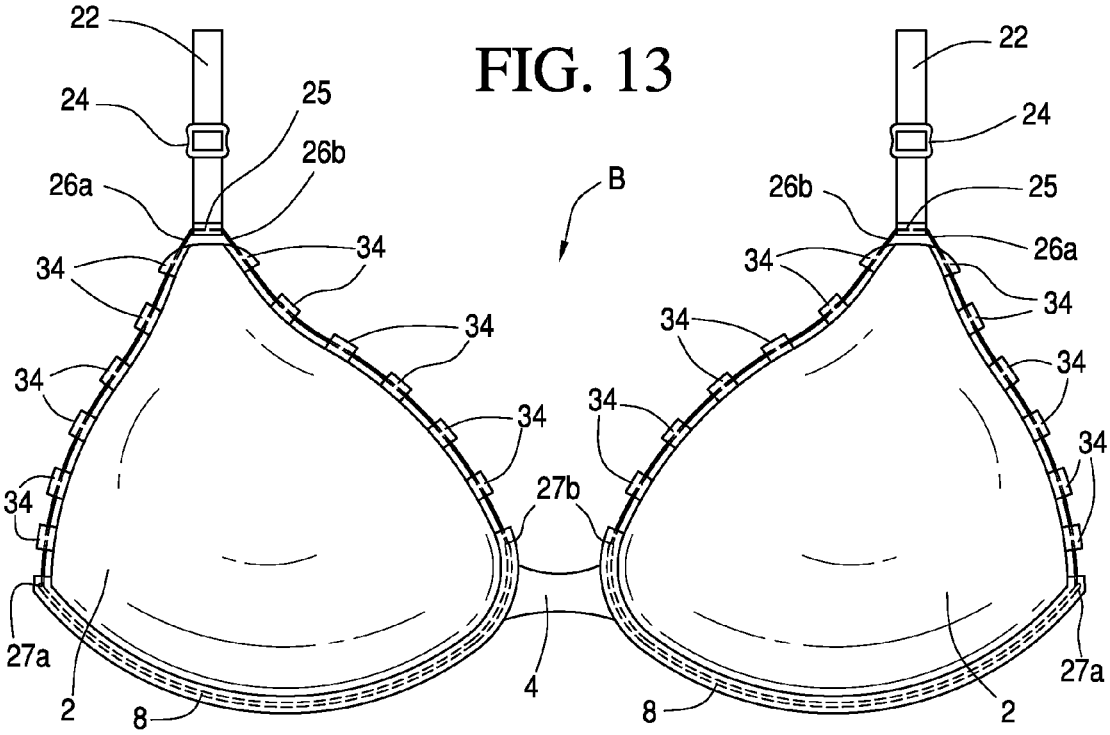

COMFORT SUPPORT BRASSIER AND METHOD

CROSS REFERENCE TO RELATED APPLICATIONS

Not applicable.

BACKGROUND

1. Field of the Invention

This invention relates to brassieres. In particular, this invention relates to improved brassieres that provide lift, support and comfort to the wearer.

2. Background of the Invention

Existing brassieres generally have upper straps that are attached to the top of the cup or cups. Most brassieres include underwire members that are positioned on the lowermost position of each cup. Existing brassieres tend to restrict the amount of vertical lift because the underwire tends to stay under the breasts, while the cup is stretched between the underwire and the top of the cup by the upper strap. Instead of providing the desired lift, the upper strap pulls the cup material across the front of the breast, which causes an undesirable flattening of the breast and causes discomfort to the wearer. Also, the majority of breast cups are formed of molded foam, which tends to pucker at the top portion of the cup when the upper strap is lifted upwardly.

An additional problem that exists is that most push up brassieres use thick foam inserts in the bottom of the cup to provide lift for the breasts. The back and side panels in those common brassieres need to be tightly worn about the wearer's torso so that a platform is provided for the breasts to rest upon. When the back and side panels are tightly worn, it is uncomfortable. Furthermore, the added foam inserts can undesirably increase the overall size of the cup for wearers who already wear large sized cups.

What is needed is a brassiere that lifts the lower edge of a cup, on both sides of the lower edge. The lower edge can include an underwire, a support strip or simple seam. It should also provide comfortable lifting support while eliminating puckers at the top or sides of the cup and it should eliminate gaps between the cup and the breast. It should also allow the side and rear panels to be worn loosely so that the entire brassiere is comfortable on the wearer's torso and breasts. The brassiere should be adaptable to be used in bikini tops, maternity tops and shaping and slimming tops. The brassiere should be usable for both underwire type and non-underwire type brassieres.

The brassiere should also allow for symmetric lifting of both breasts and allow for adjustment of lift on both sides of the cup and breast.

BRIEF SUMMARY OF THE INVENTION

The invention comprises a comfort support brassiere having at least one cup for receiving a breast. At least one shoulder strap is provided that has one end proximate to the cup member, and the shoulder strap extends over the wearer's shoulder. A take-up member is engaged with the proximate end of the shoulder strap member and the take-up member extends along each outer edge of the cup. The take-up member has two segments, each having a lower end, and each lower end is positioned substantially near a lower edge of the cup. Each end is positioned on opposite sides of the lower edge of the cup whereby when one shoulder strap is pulled upwardly, each end of the take-up member pulls the lower edge of the cup thereby providing lift and support to the wearer's breast. Each side of the take-up member can be adjusted simultaneously or independently to provide a desired custom adjustment to each side of the cup. The inner segment of the take-up member is free to move upwardly and is not anchored in a fixed position.

A pair of cups is provided that are normally connected together with a cup connector. The shoulder strap generally includes an adjuster to adjust the position of the take-up member. A side panel is attached to the outer edge of each of the cups. The side panel is connected to a back panel that includes a separable closure.

The take-up member is located within a pocket that is formed along the upper outer and inner edges of the cup. The pocket is formed by folding over the edge of the material on the outer edge of the cup and then hemming the folded over material. The take-up member may be made of a cord material or of a flat woven tape or of other desired material.

The lower edge of the cup may be a support underwire or a support strip. The support strip can be folded along its length to conform comfortably in the position between the wearer's torso and the lower portion of the breast.

The lower edge may also be a simple seam of material.

The simplicity of the invention eliminates the need for buckles, drawstrings, or other cinching devices.

Because the underwire is flexible, lifting from on or near the ends of the underwire causes the underwire to flex upwardly, thereby creating a smaller radius. The smaller radius helps to provide a more desirable rounding appearance of the breast.

The take-up member includes a pair of segments that extend about the upper inner and upper outer edges of the cup. Because the take-up member pulls outside of the breast, pressing down or mashing of the breast is eliminated. The inventive brassiere also eliminates the puckers that are common on molded foam cups and eliminates the gaps between the cup and breasts as is common on some lifting type designs.

The lifting along the outer edges of the cup eliminates the need for thick foam as a platform for the breasts to rest upon and thereby allows the side and rear panels to be worn loosely. The entire brassiere becomes more comfortable on the wearer's torso and breasts.

The inventive brassiere can be adapted to be used in bikini tops, maternity tops and shaping and slimming tops. The brassiere can also be used for both underwire type and non-underwire type cups. It can also be used with cups that have molded strips in place of an underwire or with other under cup support means.

BRIEF DESCRIPTION OF THE DRAWINGS

FIG. 7 is a section view of 6-6 from FIG. 4 showing an underwire support member.

FIG. 8 is a section view of 6-6 from FIG. 4 showing a flat support strip.

FIG. 9 is a section view of 6-6 from FIG. 4 showing a bended support strip.

FIG. 10 is a section view of 6-6 from FIG. 4 showing a simple hemmed edge.

FIG. 11 is a section view of 7-7 from FIG. 4 showing a cord segment of a take-up member.

FIG. 12 is a section view of 7-7 from FIG. 4 showing a flat tape segment of a take-up member.

FIG. 13 is a front view of the inventive brassiere with each take-up member in a relaxed position in guide loops.

DETAILED DESCRIPTION OF THE INVENTION

Figure 1:
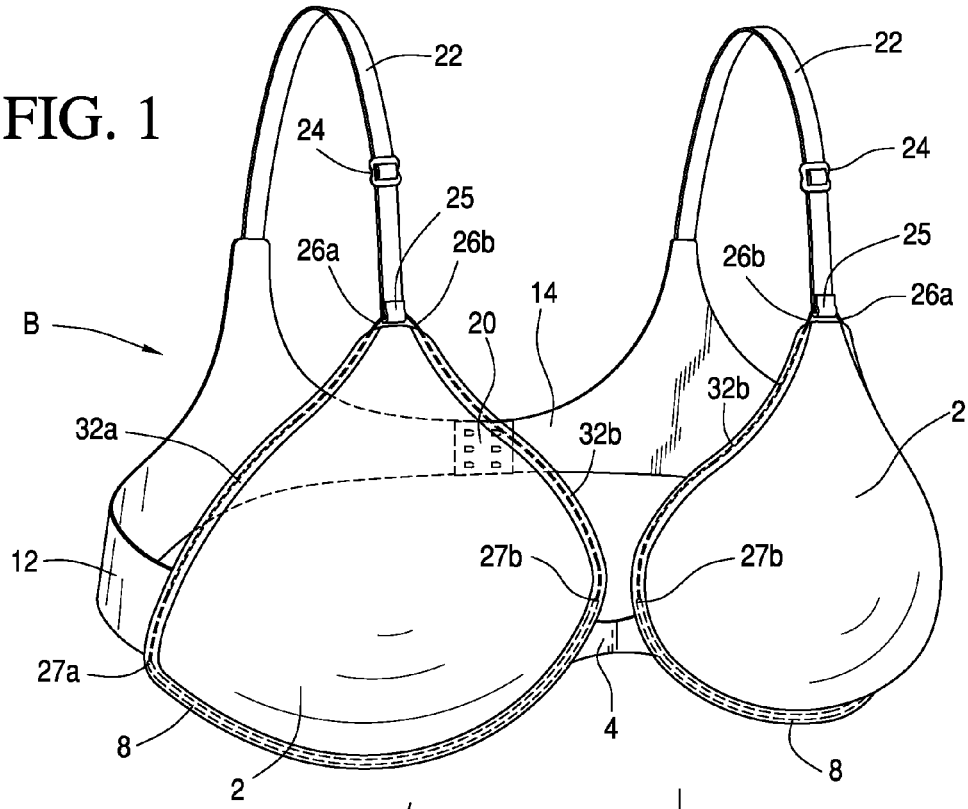
FIG. 1 shows an isometric view of the inventive support brassiere.

Refer now to the drawings, in which like reference numbers refer to like parts throughout the various drawings.

Reference B is directed generally to the brassiere that is the subject of the invention. Brassiere B includes a pair of cups 2 that are typically connected with a cup connector 4. Each cup 2 includes an outer guide pocket 32*a* and an inner guide pocket 32*b*. An outer take-up segment 26*a* is positioned inside of the outer guide pocket 32*a* and an inner take-up segment 26*b* is positioned inside of the inner guide pocket 32*b*. Each take-up segment 26*a*, 26*b* is connected to the shoulder strap end 25. The shoulder strap 22 extends between the shoulder strap end 25 and the back panel 14. The back panel 14 is connected to each cup 2 with side panels 12. The back panel connects together with a closure 20.

Throughout the specification, the take-up member includes an outer take-up segment 26*a* and an inner take-up segment 26*b*. The inner take-up segment 26*a* and outer take-up segment 26*b* can be adjusted independently as required to custom fit the cup 2 to each breast 100. The outer take-up segment 26*a* and inner take-up segment 26*b* can also be connected together to form a continuous length. A take-up segment adjuster 62 is shown in FIG. 4A, which can be provided at the shoulder strap end 25 to secure the independent positions of the outer take-up segment 26*a* and the inner take-up segment 26*b*, or the upper end of the outer take-up segment 26*a* and upper end of the inner take-up segment 26*b* can be tied together at the shoulder strap end 25. In FIG. 4A, the outer take-up segment end 62*a* and the inner take-up segment end 62*b* are shown extending from the take-up segment adjuster 62. When the outer take-up segment 62*a* and inner take-up segment 62*b* are in the desired positions, they can then be secured with the take-up segment adjuster 62.

The outer take-up segment 26*a* and the inner take-up segment 26*b* can also be a continuous length, in which case each segment is adjusted simultaneously.

Although each cup 2, shoulder strap 22, buckle 24, shoulder strap end 25 and the related parts are shown as being the same size and shape on each side of the brassiere B, it is contemplated that variations in the relative size of the individual parts of the brassiere can be changed as desired.

A lower edge 8 is shown in FIGS. 1-8. The lower end of the outer take-up segment 26*a* is attached at the outer attachment point 27*a* on or near the outer end of the lower edge 8. The lower end of the inner take-up segment 26*b* is attached at the inner attachment point 27*b* on or near the inner end of the lower edge 8.

The shoulder strap 22 may be non-stretchable or stretchable material that is sufficiently wide to be comfortable to the wearer. The shoulder strap is adjustable with buckle 24.

Figure 2:
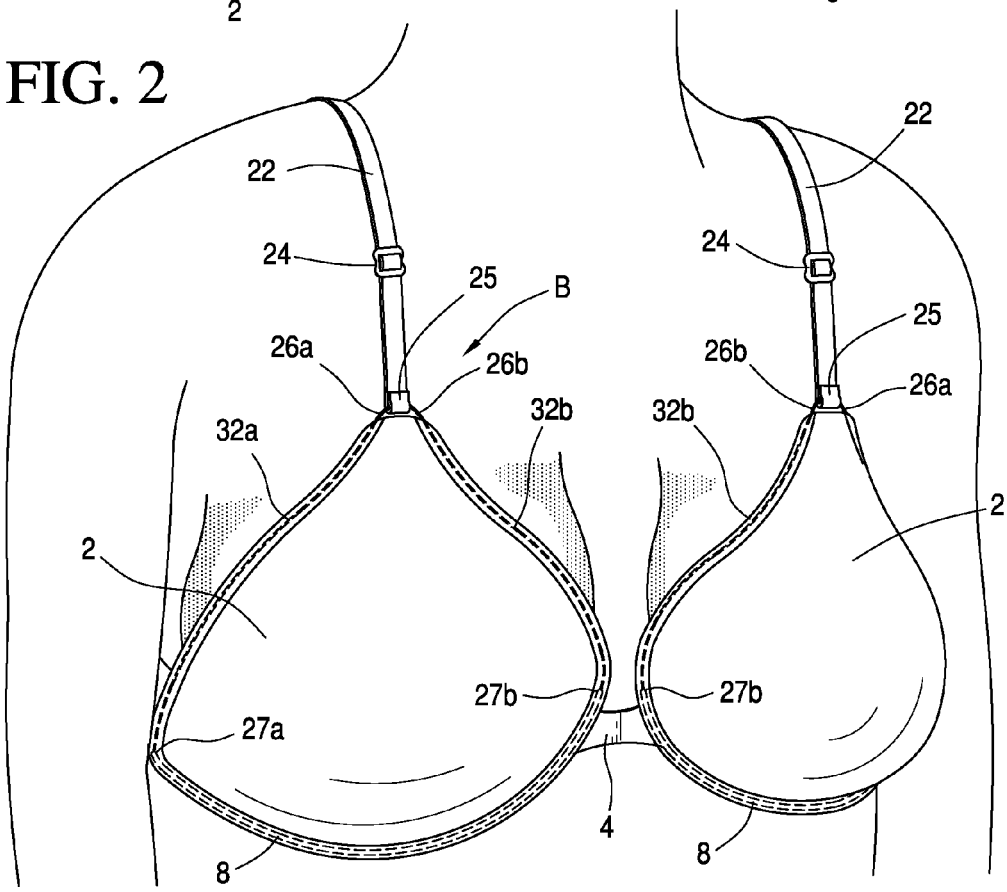
FIG. 2 shows an isometric view of the inventive support brassiere as worn with each take-up member in a relaxed position.

In FIGS. 1-2 brassiere B is shown in the relaxed position. In the relaxed position, the outer take-up segment 26*a* is contained within outer guide pocket 32*a* and the inner take-up segment 26*b* is contained in the inner guide pocket 32*b*. When the outer take-up segment 26*a* and inner take-up segment 26*b* are contained within the outer guide pocket 32*a* and inner guide pocket 32*b*, respectively, the shoulder strap end 25 is positioned close to the top of the cup 2.

Figure 3:
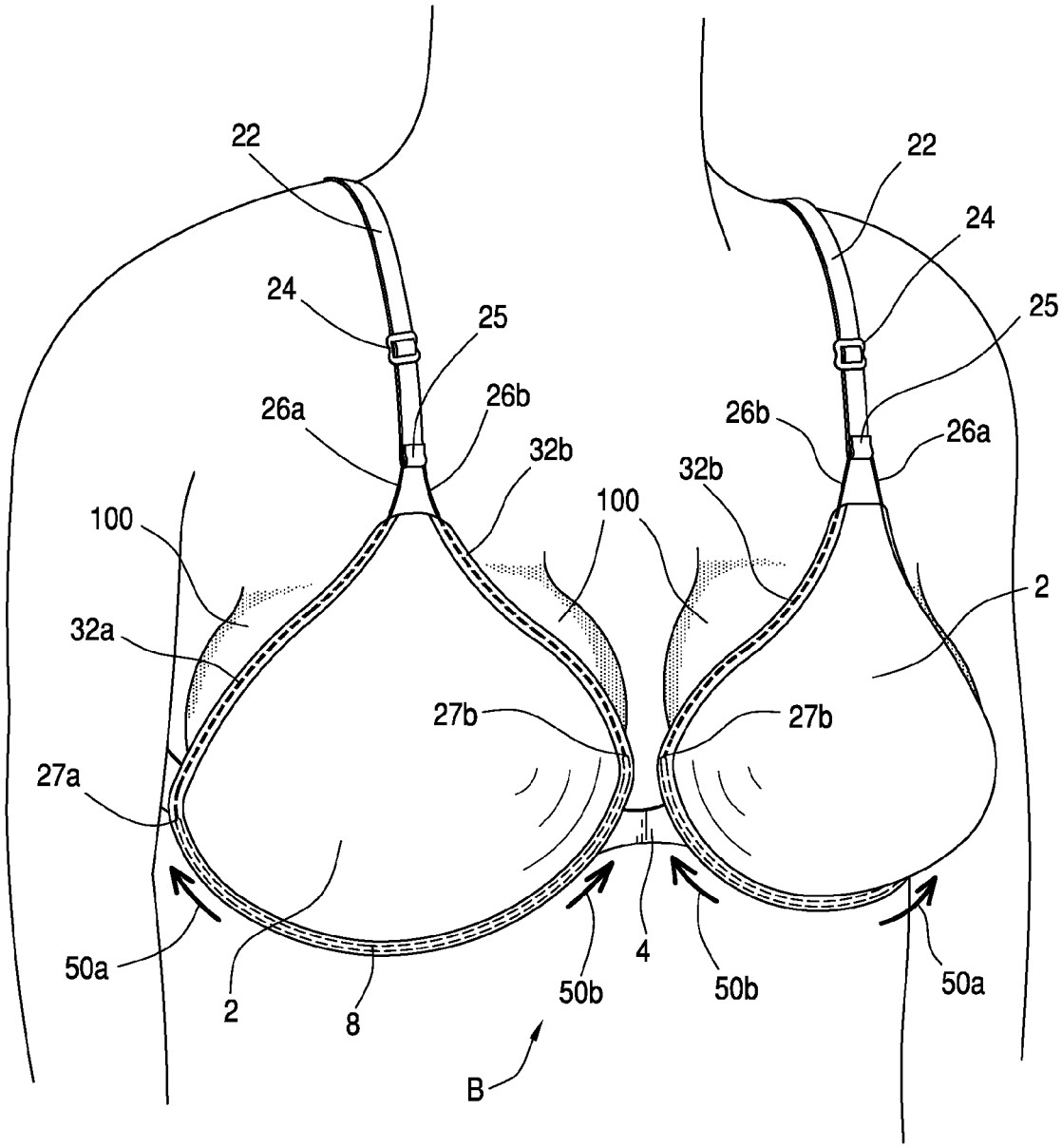
FIG. 3 shows the inventive support brassiere as worn with the each take-up member in a lifted position.

In FIG. 3 the brassiere B is shown in the lifted position. In the lifted position the outer take-up segment 32*a* and inner take-up segment 32*b* are pulled up by the shoulder strap 22, which is connected to the shoulder strap end 25. The outer take-up segment 26*a* slides within outer guide pocket 32*a* mand the inner take-up segment 26*b* slides within inner guide pocket 32*b*. The lower end of the outer take-up segment 27*a* is attached at the outer attachment point 27*a* on or near the outer end of the lower edge 8 and the lower end of the inner take-up segment 32*b* is attached at the inner attachment point 27*b* on or near the inner end of the lower edge 8. When the outer take-up segment 26*a* and inner take-up segment 26*b* are pulled upwardly by pulling upwardly on the shoulder strap 22, tension is applied to each end of the lower edge 8 at outer attachment point 27*a* and inner attachment point 27*b*. As the lower edge 8 is lifted, it lifts each cup 2 and the breast in each cup 2. Because the lower edge 8 is flexible, when tension is applied at each end of the lower edge 8, the lower edge 8 bends upwardly in a curved shape. The upward bending of the lower edge 8 provides desirable rounding to the lower portion of each breast. If underwire 9 (See FIG. 7) is used for the lower edge 8, the underwire 9 tends to bend upwardly in a resilient curved shape and the underwire 9 can maintain the desired curved shape as tension is applied by outer take-up segment 26*a* and inner take-up segment 26*b*. Tension is applied to the outer end of underwire at approximately the position shown as 50*a* and tension is applied on the inner end of the underwire at the position shown as 50*b*. (See FIG. 3). This prevents tension or stress from being applied to the outer surface of the cup 2 thereby preventing pushing or pressing down on the breast.

The upward position of the outer take-up segment 26*a* and inner take-up segment 26*b* can be secured with the buckle 24 on the shoulder strap 22. The relative positions of the outer take-up segment 26*a* and the inner take-up segment 26*b* can be changed to adjust the lifting of each breast to the most desired and comfortable position. In other words, outer take-up segment 26*a* may be pulled out further from the outer guide pocket 32*a* than the amount of inner take-up segment 26*b* pulled from inner guide pocket 32*b*.

Figure 4:
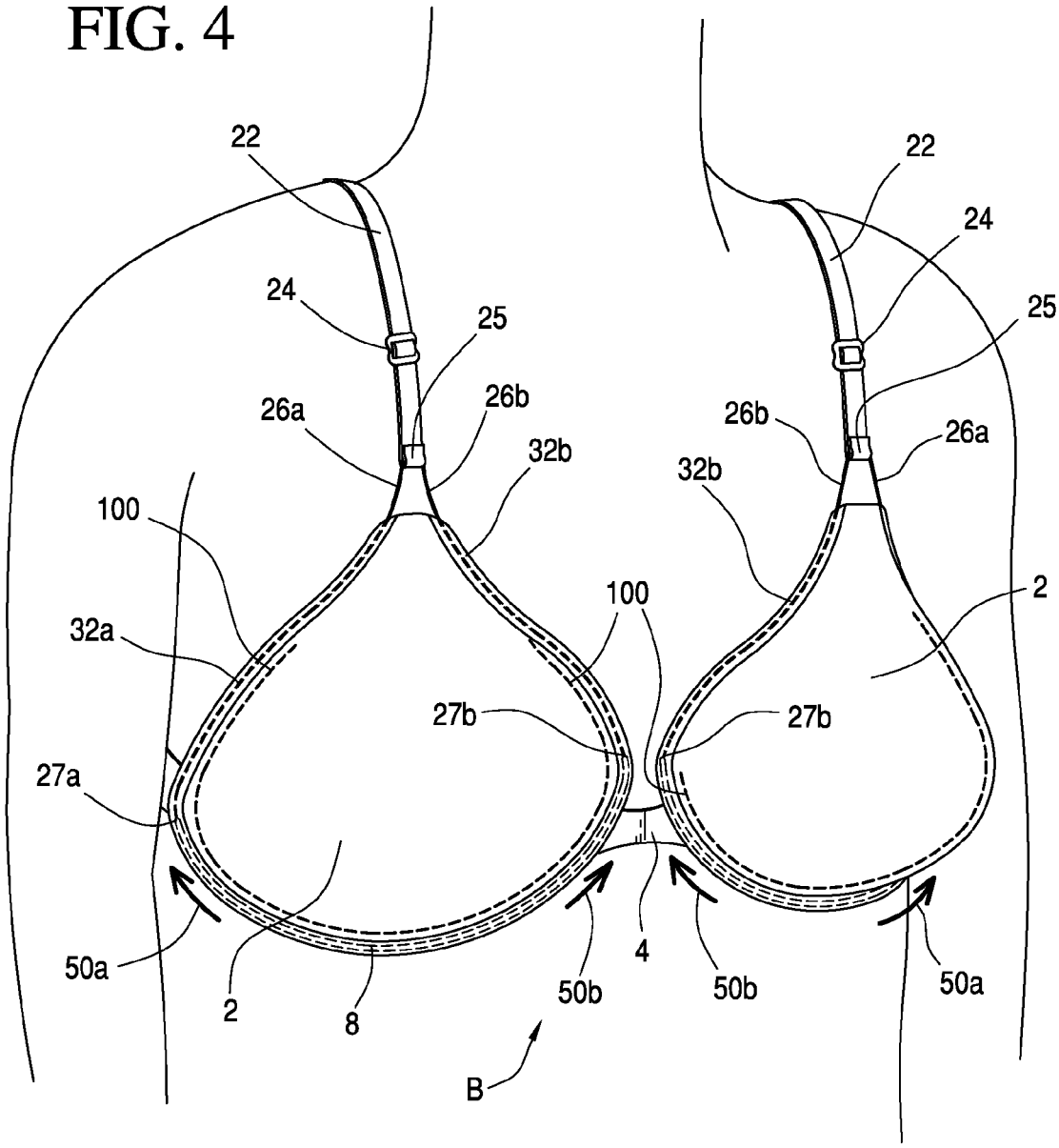
FIG. 4 is an alternative view showing the inventive support brassiere as worn with each take-up member in a lifted position and with the breasts completed captured by the outer and inner segments of the take-up member.
Figure 4A:
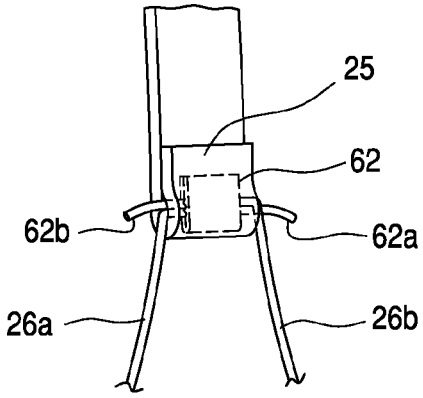
FIG. 4A shows the shoulder strap end with the adjustable inner take-up segment and outer take-up segment with the ends extending from the take-up segment adjuster.

In FIG. 4, the brassiere B is shown with the outer guide pocket 32*a* and inner guide pocket 32*b* positioned on the upper sides of the breast 100. This allows for the outer take-up segment 26*a* and inner take-up segment 26*b* to fully capture the lower portion of the breast 100 with the lower edge 8 and also the upper portion of the breast 100 with the outer take-up segment 26*a* and inner take-up segment 26*b*. The complete circling of the breast with tension from the take-up segments helps to improve the roundness of the breast and also extends the breast outwardly.

Figure 5:
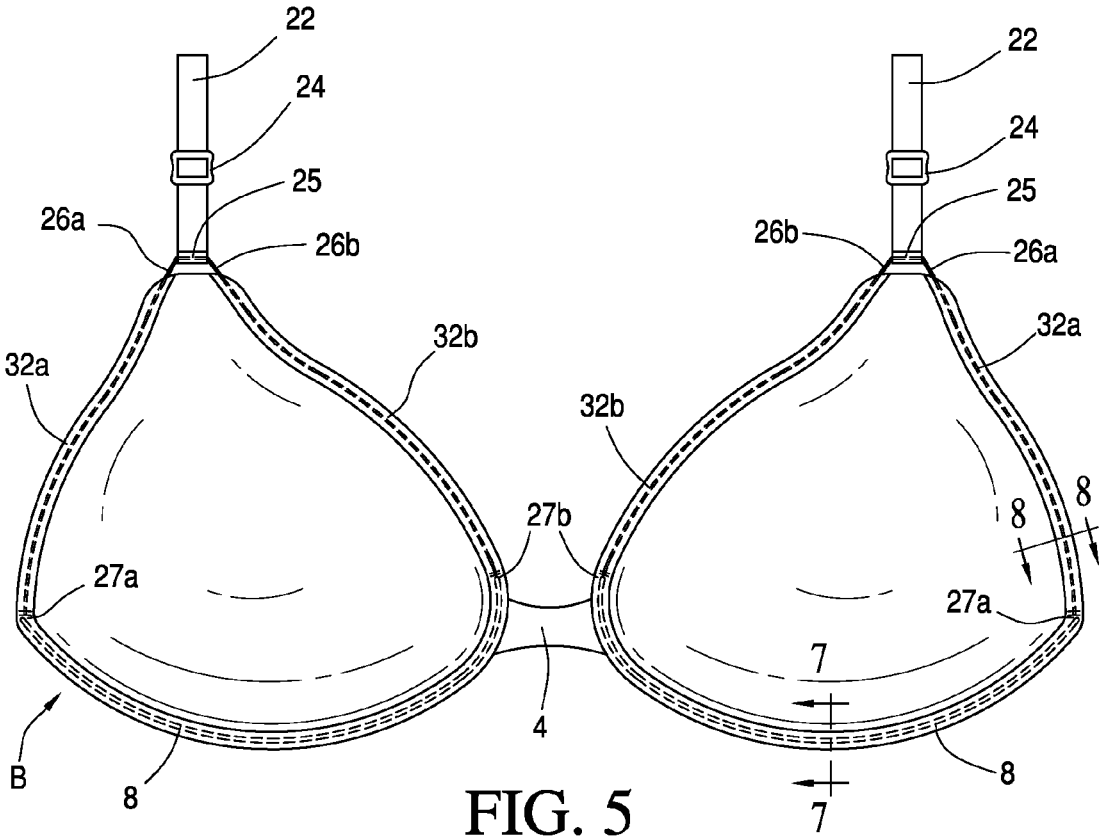
FIG. 5 is a front view of the inventive brassiere with each take-up member in a relaxed position.
Figure 6:
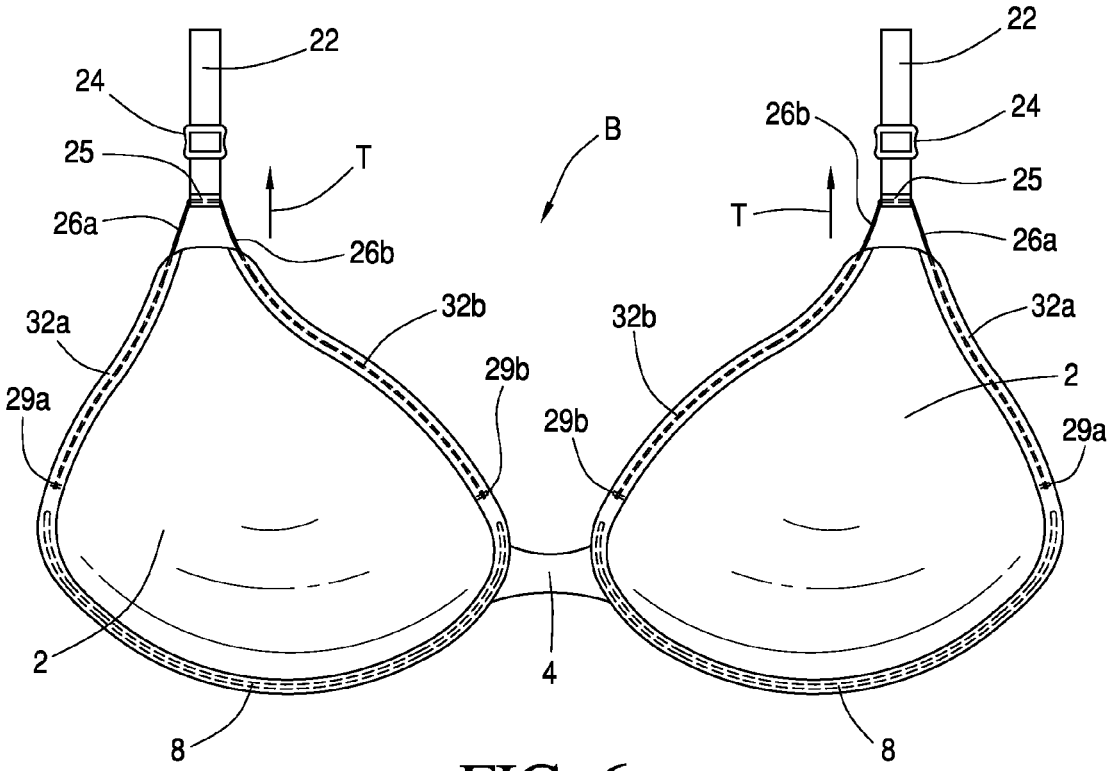
FIG. 6 is a front view of the inventive brassiere with each take-up member in a lifted position.

In FIG. 5 the brassiere B is shown in the relaxed position with sections 7-7 and 8-8 identified. In FIG. 6, the brassiere B is shown in the lifted position. The outer attachment point 29*a* and the inner attachment point 29*b* are both separated from the outer end and the inner end of the lower edge 8. The lower edge 8 is not anchored on one end as if a fulcrum but instead is pulled upwardly when tension T is provided by outer take-up segment 26*a* and inner take-up segment 26*b*. The outer take-up segment 26*a* and inner take-up segment 26*b* can be pulled upwardly in equal amounts or in different amounts, depending up the desired positioning of the lower edge 8.

FIGS. 7-10 show alternative embodiments at section 7-7 of FIG. 5. FIG. 7 shows a cross section from 7-7 of FIG. 5 of an underwire 9. The underwire 9 provides resiliency that curves in the shape of the lower portion of the breast as tension T is imposed on outer take-up segment 26*a* and 26*b* (See FIG. 6). It is also possible to bend the underwire 9 into a desired curved shape such that it stays in the desired curved shape without tension T from the take-up segments 26*a*, 26*b*. The underwire 9 can be constructed of conventional wire material or can be made of flexible graphite or other desired material. The underwire 9 is retained in the cup 2 with a fold over of material from the cup at seam 6.

FIG. 8 shows a cross section from 6-6 of FIG. 4 with support strip 10. The support strip can be molded from a desired polymer and is retained in the cup 2 with a fold over of material from the cup at seam 6.

FIG. 9 shows a cross section from 6-6 of FIG. 4 with a bent support strip 10*a*. The bent support strip 10*a* is retained in the cup 2 with a fold over of material from the cup at seam 6.

FIG. 10 shows a cross section from 6-6 of FIG. 4 with a simple seam 6. Each cup 2 can include a simple seam 6 on the lowermost portion of the cup 2. In such a configuration, the outer take-up segment 26*a* and inner take-up segment 26*b* pull upwardly on the lower edge 8, which includes the simple seam 9 between connection points 27*a*, 27*b* or 29*a*, 29*b*. The simple seam 9 of the cup 2 pulls upwardly, underneath the breast.

FIGS. 11-12 show alternative embodiments at section 8-8 of FIG. 5. FIG. 11 shows a cross section from 8-8 of FIG. 5 of a cord 26.

FIG. 12 shows a cross section from 8-8 of FIG. 5 of a flat tape 28. The flat tape 28 is typically low stretch material to provide upward tension on the lowermost portion of the cup 2.

In FIG. 13 the outer take-up segment 26*a* and inner take-up segment 26*b* are restrained by a plurality of guide loops 34. The brassiere B is shown in the relaxed position. The end of outer take-up segment 27*a* is connected at 27*a* and the end of the inner take-up segment 26*b* is connected at 27*b*. The connection points 27*a*, 27*b* can be moved away from the ends of the lower edge 8 as desired or they can be on or near each end of the lower edge 8. A flat tape 28 (See FIG. 12) may also be used in place of the cord 26 used for outer take-up segment 26*a* or inner take-up segment 26*b*.

Figure 14:
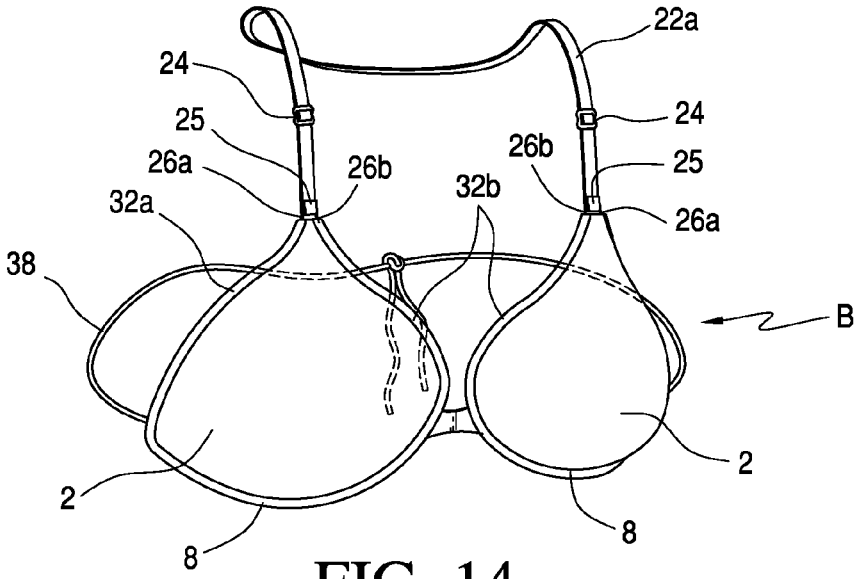
FIG. 14 is a perspective view of the inventive brassiere adapted for use with a bikini top.

In FIG. 14 an embodiment is shown wherein the brassiere B is adapted to be used with a bikini top. The shoulder strap 22*a* is a continuous length of substantially non-stretchable fabric tape that includes two ends 25. The outer lifting member 26*a* and inner lifting member 26*b* are attached to each end 25. A tie 38 is used to secure the brassiere B behind the wearer's back. Alternative closures may also be used to secure the brassiere B behind the wearer's back.

Figure 15:
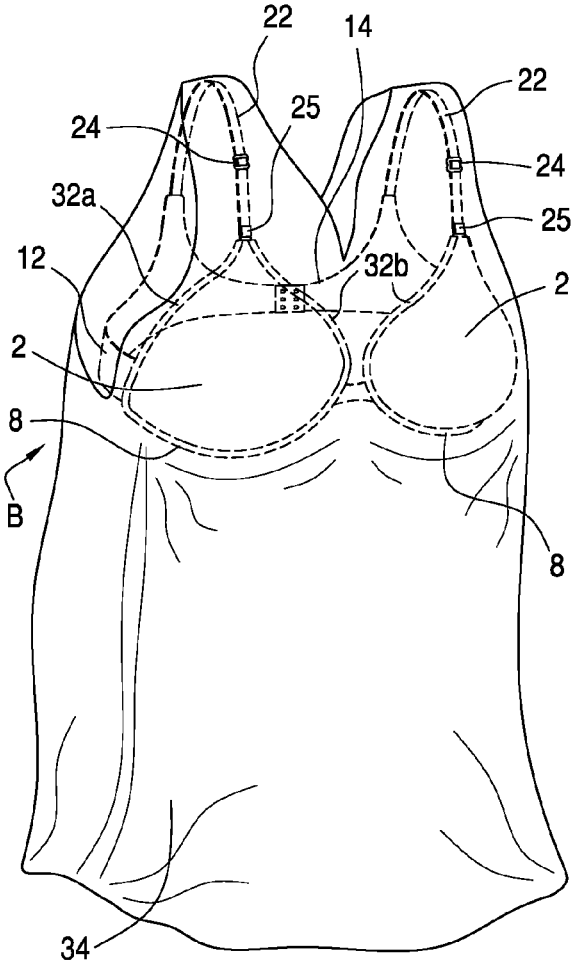
FIG. 15 is a perspective view of the inventive brassiere adapted for use with a maternity top.

In FIG. 15 an embodiment is shown wherein the brassiere B is adapted to be used with a maternity top. The brassiere B is sewn or otherwise attached to the maternity midriff 34. The midriff 34 may fully cover the brassiere B or it may only extend below each cup 2.

Figure 16:
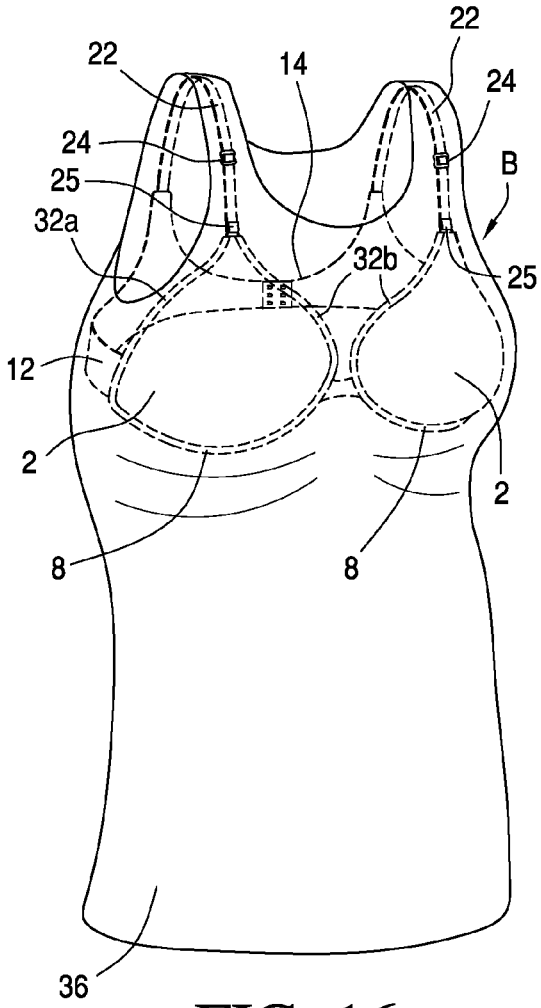
FIG. 16 is a perspective view of the inventive brassiere adapted for use with a shaping top.

In FIG. 16 an embodiment is shown wherein the brassiere B is adapted to be used with a slimming top. The brassiere B is sewn or otherwise attached to the slimming midriff 36. The midriff 36 may fully cover the brassiere B or it may only extend below each cup 2.

The invention is not limited to the above-described embodiments and other embodiments may fall within the scope of the invention, the claims of which follow.

What is claimed is:

1. A comfort support brassiere comprising:

a. at least one cup for receiving a breast; said at least one cup connected to a second cup with a connector member; said at least one cup and said second cup are connected together behind a wearer's back with a selected closure;

b. at least one shoulder strap having one end proximate to said at least one cup, said shoulder strap extending over the wearer's shoulder and being unattached to said at least one cup;

c. a take-up member engaged with said proximate end of said at least one shoulder strap member, said take-up member extending along and slideably secured to an inner edge and an outer edge of said at least one cup; and d. said take-up member having two ends, each end of said take-up member being positioned substantially near each end of a lower edge having opposite ends; said lower edge positioned substantially near the lower portion of the breast; said lower edge being separate and distinct from said take-up member; each end of said take-up member being positioned on the opposite ends of said lower edge of said at least one cup; whereby when said at least one shoulder strap is pulled upwardly, each said end of said take-up member pulls each end of said lower edge of said at least one cup; said take-up member encircles the sides of the breast and said lower edge is positioned between the wearer's torso and the lower portion of the breast cup thereby providing upward lift and support to the wearer's breast and improving the roundness of the breast and extending the breast outwardly.

2. A comfort support brassiere as claimed in claim 1 wherein said take-up member is selected from the group consisting of cord and flat tape.

3. A comfort support brassiere as claimed in claim 1 wherein each said segment of said take-up member is located within a pocket, at least one said pocket being positioned along at least said outer edge of said at least one cup.

4. A comfort support brassiere as claimed in claim 1 wherein each said segment of said take-up member is positioned within guide loops, said guide loops being positioned along at least said outer edge of said at least one cup.

5. A comfort support brassiere as claimed in claim 1 wherein said lower edge comprises a wire member.

6. A comfort support brassiere as claimed in claim 1 wherein said lower edge comprises a support strip.

7. A comfort support brassiere as claimed in claim 6 wherein said support strip is bent along its length.

8. A comfort support brassiere as claimed in claim 1 wherein said lower edge comprises a simple seam of material.

9. A comfort support brassiere according to claim 1 wherein said lower edge comprises a semi-rigid support strip.

10. A comfort support brassiere according to claim 1 wherein said shoulder strap includes an adjuster to adjust the position of said take-up member.

11. A comfort support brassiere according to claim 1 wherein a side panel is attached to the outer edge of each of said cups and each said side panel is connected to a back panel that includes a separable closure.

12. A comfort support brassiere according to claim 1 wherein said brassiere further comprises a maternity midriff that extends below said at least one cup of said support brassiere and wraps around the wearer.

13. A comfort support brassiere according to claim 1 wherein said brassiere further comprises a shaping midriff that extends below said at least one cup of said support brassiere and wraps around the wearer.

14. A comfort support brassiere according to claim 1 wherein said shoulder strap comprises a single continuous length that wraps around the back of the wearer's neck and wherein a rear closure is provided to secure said at least one cup to the wearer.

15. A comfort support brassiere according to claim 1 wherein each said segment of said take-up member is adjustably connected to said proximate end of said shoulder strap.

16. A method of constructing a comfort support brassiere comprising the steps of:

a. providing at least one cup for receiving a breast; connecting said at least one cup to a second cup with a connector member; connecting said at least one cup and said second cup together behind a wearer's back with a selected closure;

b. providing at least one shoulder strap having one end proximate to said at least one cup and unattached to said at least one cup;

c. extending said shoulder strap over the wearer's shoulder;

d. engaging a take-up member with said proximate end of said at least one shoulder strap member, extending said take-up member along and slideably secured to an inner edge and an outer edge of said at least one cup; and e. providing said take-up member with two ends, positioning each end of said take-up member substantially near each end of a lower edge having opposite ends; positioning said lower edge substantially near the lower portion of the breast and said lower edge being separate and distinct from said take-up member; positioning each end of said take-up member on the opposite ends of said lower edge of said at least one cup; whereby when pulling said at least one shoulder strap upwardly, each said end of said take-up member pulls each end of said lower edge of said at least one cup upwardly; encircling the sides of the breast with said take-up member and positioning said lower edge between the wearer's torso and the lower portion of the breast cup thereby providing upward lift and support to the wearer's breast and improving the roundness of the breast and extending the breast outwardly.

17. A method of constructing a comfort support brassiere according to claim 16 further comprising the step of providing a guide pocket for each said take-up member along each inner edge and each outer edge of said at least one cup.

* * * * *